US006048582A

United States Patent [19]

Schweizer et al.

[11] Patent Number: 6,048,582

[45] Date of Patent: Apr. 11, 2000

[54] METHOD AND APPARATUS FOR CURTAIN COATING PROVIDING A LATERAL LIQUID FILM VELOCITY EQUAL TO THE CURTAIN FALLING VELOCITY

[75] Inventors: Peter M. Schweizer, Wünnewil; Urs Troller, Trimbach, both of Switzerland

[73] Assignee: Troller Schweizer Engineering AG, Niederwangen, Switzerland

[21] Appl. No.: 09/165,989

[22] Filed: Oct. 2, 1998

[30] Foreign Application Priority Data

Oct. 3, 1997 [EP] European Pat. Off. ..... 97810733

[51] Int. Cl.[7] ..... B05D 1/30; B05C 5/00

[52] U.S. Cl. ..... 427/420; 118/324; 118/DIG. 4

[58] Field of Search ..... 427/420; 118/324, 118/DIG. 4

[56] References Cited

U.S. PATENT DOCUMENTS

| | | | |
|---|---|---|---|
| 3,632,374 | 1/1972 | Greiller | 427/420 |
| 4,479,987 | 10/1984 | Koepke et al. | 427/402 |
| 4,974,533 | 12/1990 | Ishizuka et al. | 427/420 |
| 5,395,660 | 3/1995 | Ruschak et al. | 427/420 |

FOREIGN PATENT DOCUMENTS

| | | |
|---|---|---|
| 0414721 | 3/1991 | European Pat. Off. . |
| 0737521 | 10/1996 | European Pat. Off. . |
| 0740197 | 10/1996 | European Pat. Off. . |
| 2021001 | 11/1979 | United Kingdom . |

OTHER PUBLICATIONS

P. Grassman, *Physikalische Grundlagen der Verfahrenstechnik*, 1970, Sauerländer AG, Aarau, (No Month Date).

*Primary Examiner*—Katherine A. Bareford
*Attorney, Agent, or Firm*—Ostrolenk, Faber, Gerb & Soffen, LLP

[57] ABSTRACT

In the method for curtain coating a moving support with any kind of coating solution, lateral flow is supplied to the guided curtain on both sides transversely to the length of the curtain and in parallel to the front wall of the lateral guides. The supply of the liquid film on the lateral guide is effected in such a manner that its surface velocity is equal to the falling velocity of the curtain at any point along the lateral guide. The device implementing the method features a porous plate which is arranged between the liquid supply and the curtain side. This ensures a constant coating without any disturbances due to marginal influences.

12 Claims, 3 Drawing Sheets

METHOD AND APPARATUS FOR CURTAIN COATING PROVIDING A LATERAL LIQUID FILM VELOCITY EQUAL TO THE CURTAIN FALLING VELOCITY

BACKGROUND OF THE INVENTION

The present invention refers to a method and an apparatus for curtain coating a moving support with a liquid coating material where a lateral flow is added to the guided curtain on both sides, the width of the curtain being greater than the width of the coating on the support, and the lateral flow being supplied transversely to the length of the curtain and in parallel to the front wall of the lateral guides. The invention further refers to a device for carrying out the method, comprising two lateral guides for the curtain and an installation allowing the supply of said liquid film in parallel to the rear wall of the lateral guides, as well as a device for the extraction of the liquid film. Such a method and apparatus are described in EP-A-0 740 197. Although the planar guides disclosed therein provided a certain progress over the prior art of the time, they still have drawbacks. Thus, from the point where the curtain is formed, the falling velocity of the curtain continuously increases in the falling direction due to gravitation, whereas in the liquid film which runs down along the lateral guide is not affected by gravitation because the surface velocity of the liquid film assumes a constant value on account of internal friction. When the curtain meets the lateral guide, it is only possible to match the two velocities at a single point, and a reduced stability of the curtain results due to local distortions and constrictions. The coating solution may be any kind of coating solution which is formed as a liquid coating material.

One of the main problems of curtain coating is the conservation of a stable curtain, particularly in the vicinity of the lateral guides which are necessary in order to prevent contraction of the curtain on account of surface tension forces.

The geometric design of the lateral guides of the curtain is particularly problematic if the width of the curtain is smaller than that of the coated support.

Basically, another form of lateral curtain guides according to EP-B-0 414 721 may be used, which describes a linear apparatus where the lateral guide consists of a straight bar. The disadvantage of linear lateral guides is that the falling curve of the liquid curtain depends on different parameters such as its viscosity, surface tension, volume flow, the geometric design of the pouring lip where the curtain is formed, the direction of the initial velocity of the curtain relative to the direction of the gravitation vector, etc. In most cases, the falling curve of the curtain is not linear, and it varies from one application to another if one of the above parameter varies.

Although in principle, planar lateral guides according to the patent application cited in the introduction do not have this drawback, they have other disadvantages as described. EP-A-0 737 521 also describes an approximately planar lateral guide, but the wetting liquid is supplied from above in this case as well, and a device for separating the edge from the center portion of the curtain is required.

SUMMARY OF THE INVENTION

On the background of this prior art, it is the object of the present invention to provide a method and a device which ensures an increased stability of the curtain. This object is attained by a method wherein the supply of the liquid film on the lateral guide is effected in such a manner that its surface velocity is equal to the falling velocity of the curtain at each point along the lateral guide, and by a device wherein a porous plate is disposed between the liquid supply and the curtain side.

BRIEF DESCRIPTION OF THE DRAWINGS

The invention is explained in more detail hereinafter with reference to a drawings of a preferred embodiment.

DETAILED DESCRIPTION OF THE INVENTION

Figure 1:
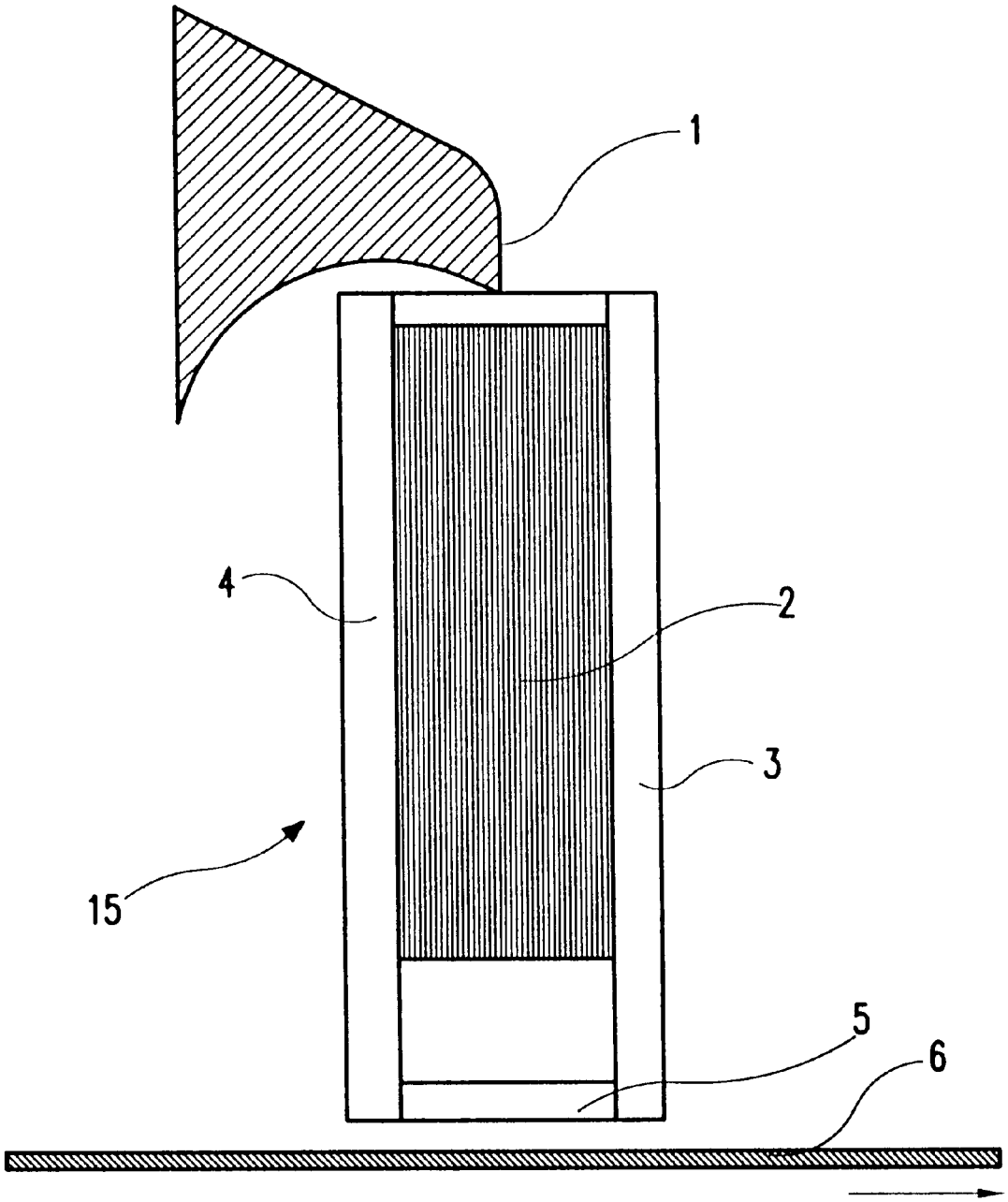
FIG. 1 shows a partly sectioned side view of a curtain coating installation of the invention.

The stability of a liquid curtain is ensured when its falling velocity is greater than the propulsion speed of disturbances everywhere in the curtain. If this criterion is fulfilled, possible disturbances cannot propagate upwards, i.e. against the falling direction of the curtain, and instead are flushed down. Based on theoretical considerations, it may be concluded that the curtain stability is impaired, inter alia, by
high surface tensions,
thin curtains, and
low falling velocities of the curtain.

Thin curtains and low falling velocities are mainly encountered in the vicinity of the lateral curtain guides since the curtain is locally constricted due to the process of wetting the lateral guide, on one hand, and because the falling velocity of the curtain is reduced by the lateral guide, on the other hand.

As previously mentioned, it has been attempted according to EP-A-0 740 197 to attenuate these drawbacks by feeding a liquid film to the planar lateral guide. Thus, the curtain does not hit a stationary, surface i.e. a strongly decelerating wall, but a moving wall in the form of a descending liquid film. However, the following drawbacks still subsist:

Due to gravitation, the falling velocity of the curtain continuously increases in the falling direction from the point where the curtain is formed, namely according to $$V_c = V_0 + \sqrt{2gx}$$

where
$V_c$=falling velocity of the curtain
$V_0$=initial velocity of the curtain
g=gravitation constant
x=falling height of the curtain as measured from the origin of the curtain In the liquid film, however, which flows down along the lateral guide, gravitation does not lead to a continuous acceleration, but due to internal friction, the surface velocity of the liquid film assumes a constant value according to $$V_f = \left(\frac{\rho g \cos(\beta) Q_f^2}{2\mu}\right)^{1/3}$$

where
$V_f$=surface velocity of the liquid film
$Q_f$=volumetric flow rate/width of the liquid flim β=angle of inclination of the liquid film with respect to the vertical direction ρ=density of the film liquid μ=viscosity of the film liquid Hence, when the curtain meets the lateral guide, it is only possible to match the two velocities at a single point. Everywhere else along the lateral guide, the two velocities are different, which results in local distortions and constrictions of the curtain edge and thus to a reduced curtain stability.

Furthermore, according to EP-A-0 740 197, the lateral guide is terminated at its lower end by a cutting blade. This blade cuts off a border zone of the curtain which is extracted along with the liquid film and therefore causes losses of coating solution which may be very costly. Another particularly negative effect is that the cutting blade, whose length in the falling direction of the curtain is limited and amounts to several millimeters, represents a lateral border in the form of a stationary wall which decelerates the curtain at the very location where it is exposed to many disturbances from the moving support web. The cutting blade therefore causes a reduction of the curtain stability as well.

The present invention eliminates the above-mentioned disadvantages, i.e. it increases the curtain stability due to the fact that the liquid film on the planar lateral curtain guide is of such a nature that its surface velocity is identical to the falling velocity of the curtain at any point along the lateral guide and therefore causes no local distortions and constrictions of the curtain, and because there is no stationary wall in the form of a cutting blade in the lower section of the curtain which might decelerate the descent of the curtain.

Figure 2:
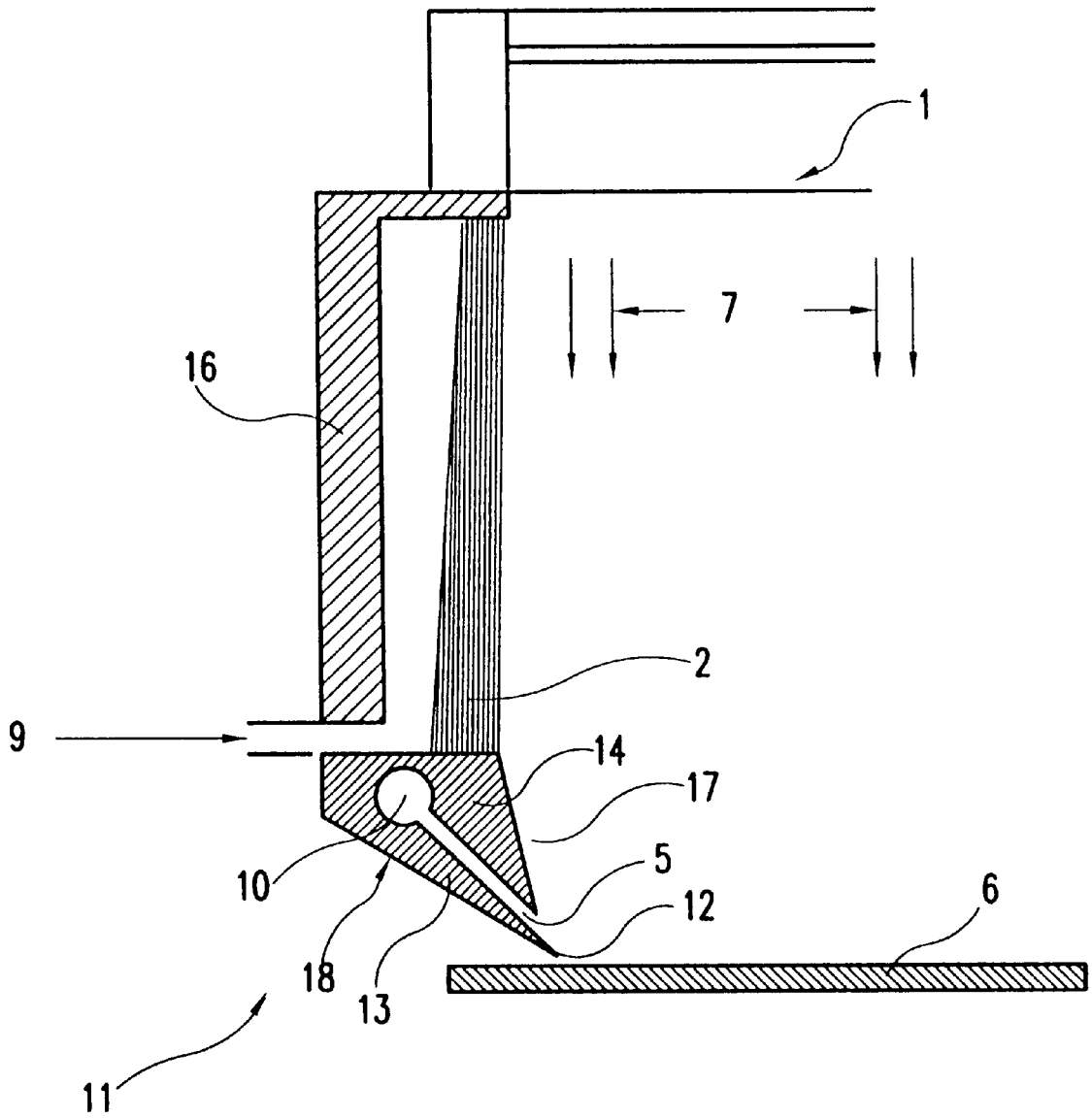
FIG. 2 shows a partly sectioned front view of the installation of FIG. 1.

FIGS. 1 and 2 show the pouring lip 1, a porous plate 2 which is disposed between two edge plates 3 and 4, thus forming a channel 15, as well as a suction slit 5 and the support web 6. In FIG. 2, the curtain is indicated by the two arrows 7, whereas a water film 8 is illustrated, in FIG. 3. Further shown are water supply 9 and vacuum line 10 which leads to suction slit 5. Furthermore, a part of rear wall 16 of the lateral guide is visible in which supply 9 is arranged.

In channel 15, a liquid of low viscosity, preferably water, runs down vertically. The temperature of this liquid must be equal to the temperature of the coating solution in the curtain.

The width of channel 15, which corresponds to the width of porous plate 2 (see FIG. 1), must be chosen such that the curtain, depending on its falling curve, may adhere to the liquid film without hindrance, and is preferably between 10 and 20 mm.

The depth of the channel must be somewhat greater than the thickness of the liquid film flowing in it, i.e. 0.2 to 0.4 mm, preferably 0.5 to 3.0 mm Except for its lowermost section, the surface of the channel facing the curtain is composed on its entire length of a porous material through which the liquid flows that forms the liquid film on the lateral edge. Thus, the obtained liquid film is constantly supplied with liquid all along the flowing direction, so that the thickness of the liquid film continuously increases from the top to the bottom, see also FIG. 3.

The porous material is in the form of a plate 2 whose thickness $H_p$ varies over the length of the lateral guide. The liquid is supplied to the porous plate from supply 9 which is arranged behind porous plate 2 on the entire length of the lateral guide. This supply is connected in turn to a non-represented liquid supply system, e.g. a tank with a pump.

The thickness $H_p$ of the porous plate has to be designed such that at any point thereof, the precise amount of liquid may flow through the plate which allows a downward surface velocity of the liquid film created on the other side of the plate that corresponds exactly to the continuously increasing falling velocity of the curtain.

Figure 3:
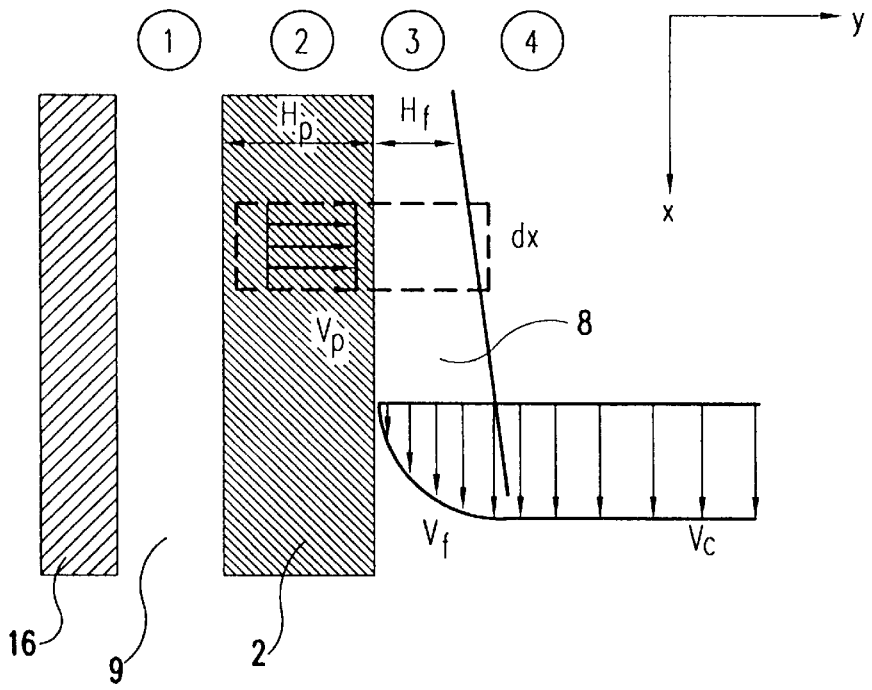
FIG. 3 shows the flow of the liquid film along the porous plate shown in FIG. 1.

With regard to a reference volume, i.e. the broken rectangle in FIG. 3, the plate thickness can be calculated on the basis of the following considerations:

The increase of the volume flow/channel width of the liquid film between the entrance into and the exit from the reference volume exactly corresponds to the volume flow/channel width which flows into the reference volume through the porous plate. The latter volume flow, however, is equal to the product of the flow rate through the porous plate and the height dx of the control volume, see FIG. 3. Accordingly, $$dQ_f = dQ_p = V_p dx$$

$$\frac{dQ_f}{dx} = V_p$$

The velocity of liquid flowing a through porous plate may be calculated e.g. according to P. Grassmann, *Physikalische Grundlagen der Verfahrenstechnik,* 1970, Sauerländer, Aarau:

$$V_p = \frac{1}{5}\frac{\Delta p}{H_p}\frac{\varepsilon^3}{(1-\varepsilon)^2 S^2 \mu} \tag{1}$$

where $V_p$=liquid velocity in the porous material

Δp=pressure drop across the porous plate $H_p$=thickness of the porous plate

μ=viscosity of the liquid flowing through the porous material

ϵ=porosity of the porous material

S=surface per volume of the porous material

If the terms for the falling velocity of the curtain and for the surface velocity of the liquid film are equated, an expression for the volume flow per channel width of the liquid film is obtained which is a function of the longitudinal coordinate x:

$$Q_f = \left[\left(V_0 + \sqrt{2gx}\right)^3 2\frac{\mu}{\rho g \cos(\beta)}\right]^{1/2} \tag{2}$$

If this expression is differentiated by x and equated with the flow rate through porous materials, an expression for the thickness of the porous plate as a function of x is obtained:

$$H_p(x) = \frac{1}{5}\frac{(p_0 + \rho g x)}{\frac{dQ_f}{dx}}\frac{\varepsilon^3}{(1-\varepsilon)^2 S^2 \mu} \tag{3}$$

Figure 4:
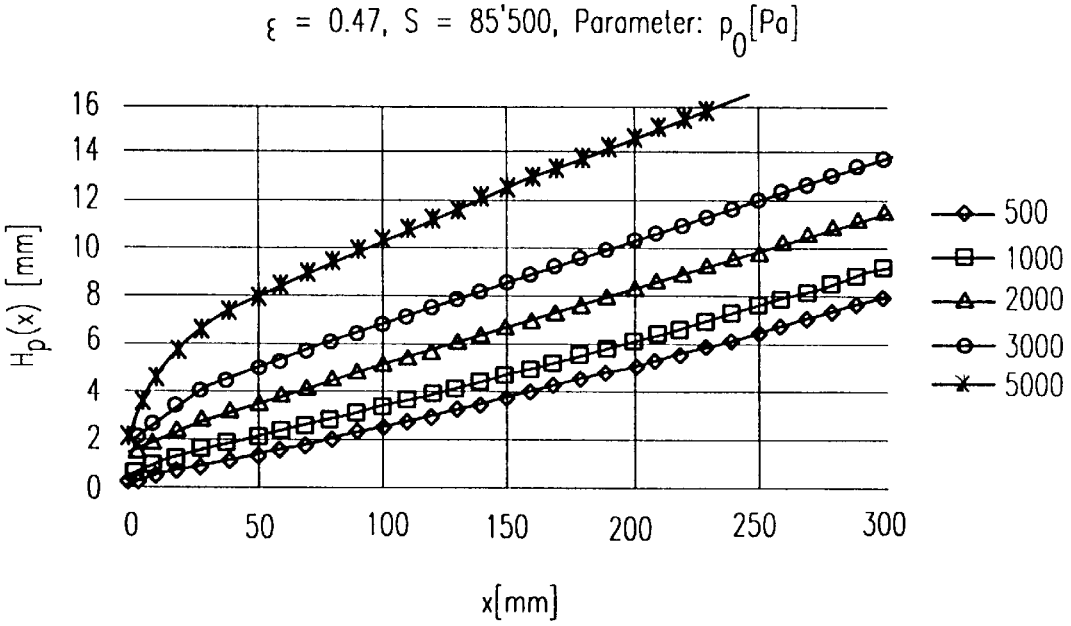
FIG. 4 shows a diagram of the thickness of the porous plate as a function of the distance along the curtain edge.

Hence, the thickness of the porous plate depends on the properties of the flowing liquid and of the porous material, as well as on the liquid pressure po behind the porous plate, which determines the minimum thickness of the plate. The dependence of the plate thickness from the distance along the plate and the liquid pressure $p_0$ is shown in FIG. 4 by way of an example.

For a porosity of 0.47 and a liquid pressure behind the porous plate of 3000 Pa, the thickness of the porous plate varies e.g. between approx. 2 mm and approx. 8.7 mm over a length of the lateral border of 150 mm.

The lower section 11 of the channel is not made of a porous material but of a solid material of good wetting properties. This lower section of the channel is composed of a lower portion 13 and an upper portion 14. The surface 17 on the curtain side of the upper portion is slightly inclined with respect to the vertical direction in order to increase the stability of the curtain. The angle of inclination is preferably between 1° and 5°.

At the lower end of the channel, i.e. the lower section 11 thereof, the suction slit 5 is provided which extends across the entire channel width transversely to the liquid flow. This suction slit, whose height is between 0.1 and 1.0 mm, preferably between 0.3 and 0.5 mm, extracts the liquid flowing through the porous plate, as well as possibly a small quantity of the curtain liquid.

The separation of the liquid which is extracted from the curtain which is applied to the support is effected at the lower edge 12 of the suction slit. The edge is located at the end of the lower portion 13 of the suction slit, the lower surface 18 of said lower portion including an angle between 1° to 60°, preferably of 45° to 60° with respect to the horizontal direction. Edge 12 of the suction slit furthermore projects by a distance between 0 and 5 mm, preferably between 1 and 3 mm, from the upper portion 14 of the suction slit. This projecting edge serves as an impact surface for the lateral liquid and allows for an easier extraction of the latter.

An important issue is the geometric configuration of the lower portion 13 of the curtain border. In particular, this portion must not extend in parallel to the support surface so as to form a narrow gap into which the liquid of the curtain or from the coated film might be aspired by capillary attraction, thus impairing the quality of the coated margin or even making it impossible to maintain a coherent coating process.

The lower edge 12 of the suction slit is disposed at a distance of 0.1 to 1.0 mm, preferably 0.3 to 0.5 mm above the support web. This short distance prevents the curtain from forming a large edge bulb as it is detached from the edge.

What is claimed is:

1. In a method for coating a moving support with a liquid curtain of coating material in which the curtain extends between two lateral guides and has a width greater than a width to be coated on the support, the improvement comprising:

providing two lateral guides for guiding the curtain, wherein one guide is provided on each side of the curtain, and wherein each guide is configured to supply a liquid film down the length of the respective lateral guide, and each guide includes a porous plate having a length and a width, with each porous plate being disposed between two longitudinally extending border plates so as to form a channel extending down the length of the curtain, and through which said liquid film flow is supplied and supplying a flow of a liquid film to the channel and through the porous plate at each side of the curtain to form a liquid film on the curtain side of the plate, the liquid film flow being supplied along a width perpendicular to the width of the curtain and along the length of the porous plate, wherein the porous plate varies in thickness along its length so that the surface velocity of the liquid film flow on the curtain side of the plate is equal to the falling velocity of the curtain along substantially the entire length of the lateral guides.

2. The method of claim 1, wherein the thickness of said porous plate is calculated by the expression:

$$H_p(x) = \frac{1}{5}\frac{(P_o + \rho g x)}{\frac{dQ_f}{dx}}\frac{\varepsilon^3}{(1-\varepsilon)^2 S^2 \mu}$$

wherein $$Q_f = \left(\left(V_o + \sqrt{2gx}\right)^3 \frac{2\mu}{\rho g \cos(\beta)}\right)^{1/2}$$

and $H_p$=thickness of the porous plate;

$\mu$=viscosity of the liquid flowing through the porous material;

$\epsilon$=porosity of the porous material;

S=surface per volume of the porous material;

$V_o$=initial velocity of the curtain;

q=gravitation constant;

x=distance fallen along the curtain as measured from the origin of the curtain;

$Q_f$=volumetric flow rate width of the liquid film;

$\beta$=angle of inclination of the liquid film with respect to the vertical direction;

$\rho$=viscosity of the film liquid; and $P_o$=pressure of film liquid.

3. In a device for stably curtain coating a moving support, the improvement comprising:

two lateral guides for guiding a liquid curtain, wherein one guide is provided on each side of the curtain, and each lateral guide being configured to supply a liquid film down the length of the respective lateral guide and including a respective porous plate disposed between two longitudinally extending border plates so as to form a channel through which said liquid film is supplied, said channel having a width and a depth, the porous plate having a thickness which varies along its length, such that the surface velocity of liquid film flow which passes through the porous plates is equal to the falling velocity of the curtain along substantially the entire length of the lateral guides; and an apparatus for the extraction of the liquid film at a bottom portion of the lateral guides.

4. The device of claim 3, wherein each said respective porous plate extends along substantially the entire length of said respective lateral guide and has a thickness defined by:

$$H_p(x) = \frac{1}{5}\frac{(P_0 + \rho g x)}{\frac{dQ_f}{dx}}\frac{\varepsilon^3}{(1-\varepsilon 3)^2 S^2 \mu}$$

wherein $$Q_f = \left(\left(V_o + \sqrt{2gx}\right)^3 \frac{2\mu}{\rho g \cos(\beta)}\right)\right)^{1/2}$$

$H_p$=thickness of the porous plate;

$\mu$=viscosity of the liquid flowing through the porous material;

$\epsilon$=porosity of the porous material;

S=surface per volume of the porous material;

$V_o$=initial velocity of the curtain;

q=gravitation constant;

x=distance fallen along the curtain as measured from the origin of the curtain;

$Q_f$=volumetric flow rate width of the liquid film;

β=angle of inclination of the liquid film with respect to the vertical direction;

ρ=viscosity of the film liquid; and $P_o$=pressure of film liquid.

5. The device of claim 3, wherein each lateral guide includes said respective porous plate, a rear surface parallel to said porous plate and made from a non-porous material, and said two longitudinally extending border plates connecting said porous plate and said rear surface so as to form a channel, said channel having a width between about 10 and 20 mm and a depth between about 0.2 and 4.0 mm.

6. The device of claim 3, wherein said apparatus for the extraction of the liquid film includes a suction slit arranged in the bottom portion of each lateral guide, said slit being formed by an upper portion and a lower portion having an edge which protrudes beyond that of the upper portion, wherein a lateral surface of the upper portion which faces the curtain is inclined with respect to the direction in which the curtain falls and both the edge and a lower surface of the lower portion are inclined with respect to a direction perpendicular to the direction in which the curtain falls.

7. The device of claim 6, wherein the lateral surface of the upper portion is inclined at an angle between about 1° to 5° with respect to the direction in which the curtain falls, and the lower surface of the lower portion and said edge are each inclined at an angle of between about 1° to 60° with respect to the direction perpendicular to the direction in which the curtain falls, while said edge projects a distance of between about 0 to 5 mm beyond the lateral surface of the upper portion.

8. The device of claim 7, wherein the lower surface of the lower portion and said edge are each inclined at an angle of between about 45° to 60° with respect to the direction perpendicular to the direction in which the curtain falls.

9. The device of claim 7, wherein said edge projects a distance of between about 1 to 3 mm beyond the lateral surface of the upper portion.

10. The device of claim 6, wherein said suction slit has a height of between about 0.1 and 1.0 mm, and wherein said edge of the suction slit is spaced from the support web at a distance of between about 0.1 and 1.0 mm.

11. The device of claim 10, wherein said suction slit has a height of between about 0.3 and 0.5 mm.

12. The device of claim 10, wherein said edge of the suction slit is spaced from the support web at a distance of between about 0.3 and 0.5 mm.

* * * * *